United States Patent [19]

Bernstein

[11] Patent Number: 5,037,088

[45] Date of Patent: Aug. 6, 1991

[54] HYDRAULIC RESISTANCE EXERCISER WITH RELATIVELY ROTATABLE ARMS

[76] Inventor: Lawrence A. Bernstein, 6456 Surfside Way, Malibu, Calif. 90265

[21] Appl. No.: 329,957

[22] Filed: Mar. 29, 1989

Related U.S. Application Data

[63] Continuation-in-part of Ser. No. 109,302, Oct. 15, 1987, abandoned.

[51] Int. Cl.[5] ..... A63B 21/22

[52] U.S. Cl. ..... 272/132; 272/130; 272/143; 272/145; 272/DIG. 4

[58] Field of Search ..... 272/130, 137, 143, 72, 272/135, 67

[56] References Cited

U.S. PATENT DOCUMENTS

| | | | |
|---|---|---|---|
| 2,627,330 | 2/1953 | Gantz | 74/547 X |
| 3,516,661 | 6/1970 | Hansen | 272/67 |
| 3,758,112 | 9/1973 | Crum et al. | 272/130 |
| 4,023,436 | 5/1977 | Dodge | 74/551.3 |
| 4,171,802 | 10/1979 | Stoecker | 272/130 X |
| 4,225,132 | 9/1980 | Archambault | 272/137 |
| 4,496,147 | 1/1985 | DeCloux et al. | 272/130 |
| 4,509,742 | 4/1985 | Cones . | |

FOREIGN PATENT DOCUMENTS

| | | | |
|---|---|---|---|
| 287385 | 2/1965 | Netherlands . | |
| 433319 | 8/1935 | United Kingdom | 272/137 |

*Primary Examiner*—Richard J. Apley
*Assistant Examiner*—D. F. Crosby
*Attorney, Agent, or Firm*—Poms, Smith, Lande & Rose

[57] ABSTRACT

A compact multi-purpose exercise device includes two adjustable length arms which are pivoted together at one end and which has adjustable angle handles or actuators at their other ends. At the pivot point of the two arms a hydraulic resistance member is provided which has a substantially constant force, which may be adjusted, and which is substantially independent of the speed at which the handles are actuated relative to one another. The constant force is provided by a reverse Pelton bucket, which includes a spring-biased member in the hydraulic fluid flow path which is moved to reduce hydraulic flow resistance with increased velocity of the hydraulic fluid flow. Hydraulic fluid is directed to the reverse Pelton bucket assembly by a vane which is rotatable in a hydraulic fluid chamber as the arms are rotated relative to one-another. The two arms of the exercise device are made up of four telescoping sections, with spring-mounted thumb-actuated detents operating into apertures in the inner telescoping arm sections, to hold them at any desired extension from about one foot to about three feet in length. Instead of single handles at the free ends of each of the arms, double handles or stirrups may be provided for easy operation with a person's feet or ankles, or roller wheels may be used to facilitate rowing-type excercises.

29 Claims, 6 Drawing Sheets

HYDRAULIC RESISTANCE EXERCISER WITH RELATIVELY ROTATABLE ARMS

RELATED APPLICATIONS

This is a continuation-in-part of U.S. Pat. Application Ser. No. 109,302, filed Oct. 15, 1987, now abandoned.

FIELD OF THE INVENTION

This invention relates to exeroise apparatus.

BACKGROUND OF THE INVENTION

Many types of multi-purpose exercise devices have been proposed, and Nautilus and other large bulky and expensive machines are enjoying widespread popularity. However, many persons cannot afford the time or money to visit a health club where the large exercise apparatus is normally found, nor do they wish to set aside a large portion of their living quarters to accommodate such a large and costly apparatus. Accordingly, there is a significant need for a small or compact and versatile exercising apparatus.

With regard to prior patents in the exercise field, attention is directed to N. Wright U.S. Pat. No. 4,226,415, granted Oct. 7, 1980; to C. H. Stoecker U.S. Pat. No. 4,171,802, granted Oct. 23, 1979; and to R. Ruggles U.S. Pat. No. 4,374,588, granted Feb. 22, 1983. Of these patents, the Wright U.S. Pat. No. 4,226,415 is typical of the large size, expensive exercise apparatus of the type mentioned hereinabove. On the other hand, the Stoecker and Ruggles patents are relatively smaller units but suffer from the disadvantages that they are single purpose units, and are not adapted to many different types of exercising as required for a complete and balanced exercise program In addition, all three patents are believed to include resistance arrangements which vary significantly in their resistance with the speed of actuation. This is a significant disadvantage, as it is desirable that a substantially constant resistance force be present despite variations in the speed at which the exercise device is operated.

Accordingly, principal objects of the present invention include first, providing an exercise device which is both compact and versatile, permitting many different types of exercise to be performed; and, secondly, providing a device which has a substantially constant resistance force, despite variations in the speed of actuation of the two arms relative to one another.

SUMMARY OF THE INVENTION

In accordance with one specific preferred embodiment of the invention, a compact, multi-purpose exercise device includes two telescoping arms which are pivoted together at one of their ends, and which are provided with handles at their other ends. Each of the arms is made up of telescoping sections, and detents are provided for locking the telescoping sections together to provide lengths of the arms varying from about one foot to about three feet. A hydraulic resistance unit is coupled to the ends of the arms which are pivoted together, and this hydraulic resistance unit provides substantially constant resistance to relative movement of the two arms despite changes in the speed of movement of the two arms relative to one another; and this is accomplished by a reverse Pelton bucket arrangement wherein the hydraulic fluid flow path of the hydraulic resistance unit is partially obstructed by a spring-biased element which moves backward against the spring pressure to reduce the hydraulic resistance, when higher velocity hydraulic fluid impinges upon the element.

In accordance with one broad aspect of the invention, a compact multi-purpose exercise apparatus includes telescoping arms which are pivoted together at one end, and which are provided with handles at the other end, and have a resistance unit coupled to the pivoted ends of the two arms.

In accordance with another broad aspect of the invention, an exercising apparatus includes two arms which are pivoted together and which has handles at the free ends of the arms, and is provided with a hydraulic resistance member having substantially constant resistance force with varying speeds of actuation of the two arms relative to one another. This hydraulic resistance unit may be implemented by a reverse Pelton bucket which includes a spring-biased member in the hydraulic fluid path, with the spring-biased member being movable to reduce the resistance, with increased force of hydraulic fluid flow impinging on the spring-biased element. The result is that with higher velocities, the movement of the Pelton bucket element serves to reduce the resistance and compensates for the normal increase in resistance as fluid is moved more rapidly through restricted passages.

Other features of the invention may include one or more of the following:

1. The reverse Pelton bucket element may include a sharply pointed member and in-curved bucket-shaped portions on either side thereof to receive and to respond to the jet of hydraulic fluid, to shift the Pelton bucket element.

2. The handles of the exercise device may be fully adjustable in their position from perpendicularity with the arms and substantial alignment with the pivot point of the units, to an orientation where they are substantially aligned with the arms.

3. Instead of single handles at the end of each of the arms, double handles or stirrups may be provided to facilitate actuation by the feet or the ankles.

4. As another alternative, rollers may be substituted for the handles on one of the two arms, so that rowing or similar exercises may be more readily implemented.

5. The locking arrangements for holding the telescoping sections of the arms in fixed positions relative to one another may include thumb-operated detents associated with each of the outer telescoping sections, and openings in the inner sections, with closely spaced openings in at least one of the sections to permit substantially continuous adjustment of the lengths of the arms.

6. In accordance with another feature of the invention, the two arms may be mounted in immediate proximity to one another and may have the hydraulic resistance unit mounted outside in one direction, and a display unit mounted on the other side of the pivot point of the two arms. In addition, a quick release mechanism may be provided for permitting prompt separation of the components of the system for easy storage.

Other objects, features, and advantages of the invention will become apparent from a consideration of the following detailed description and from the accompanying drawings.

DETAILED DESCRIPTION

Figure 1:
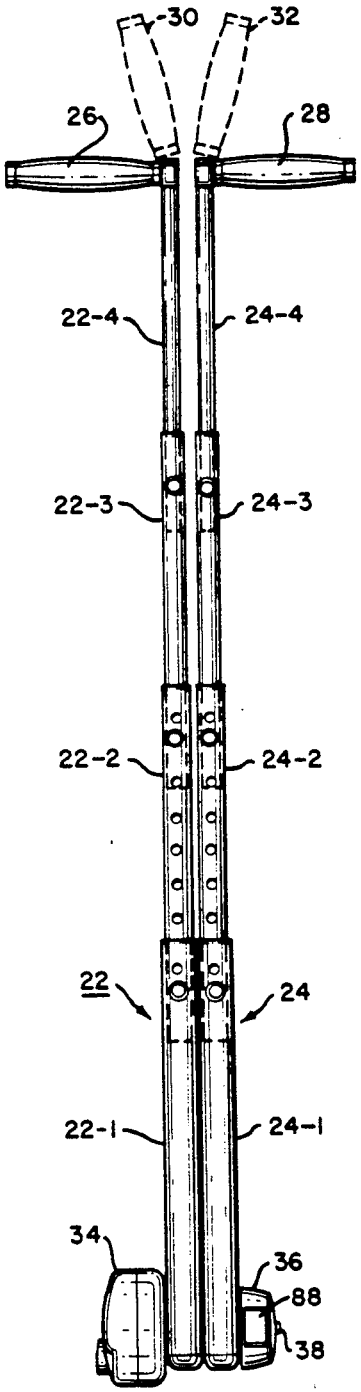
FIG. 1 is an overall front view of a compact multi-purpose exercising device illustrating the principles of the present invention, with the two arms in the fully extended position.

Referring more particularly to the drawings, FIG. 1 is a front view of an exercise device illustrating a preferred embodiment of the invention in which the two arms 22 and 24 are pivotally coupled together at their lower ends, and the rotatable handles 26 and 28 are secured to the free ends of the arms 22 and 24. Incidentally, the handles 26 and 28 may be substantially continuously variable in their orientation between the position shown in solid lines in FIG. 1 at 26, 28 and the positions shown in dashed lines at 30, 32. This may be accomplished by having separate tapped holes into which the handles 26 and 28 may be secured, or by having ratchet-type mountings for the two handles permitting substantially continuous adjustment and fixation at any desired angle.

Each of the arms 22 and 24 are made up of a series of telescoping sections designated 22-1 through 22-4, for the four sections making up the arm 22, and similarly designated by the reference numerals 24-1 through 24-4 for the four sections making up the arm 24. Aligned with the pivot axis of the arms 22 and 24, at the lower end of the showing of FIG. 1, is the hydraulic resistance unit 34, and the housing 36 carrying the quick release actuator 38 one end of which appears to the lower right in FIG. 1.

Figure 2:
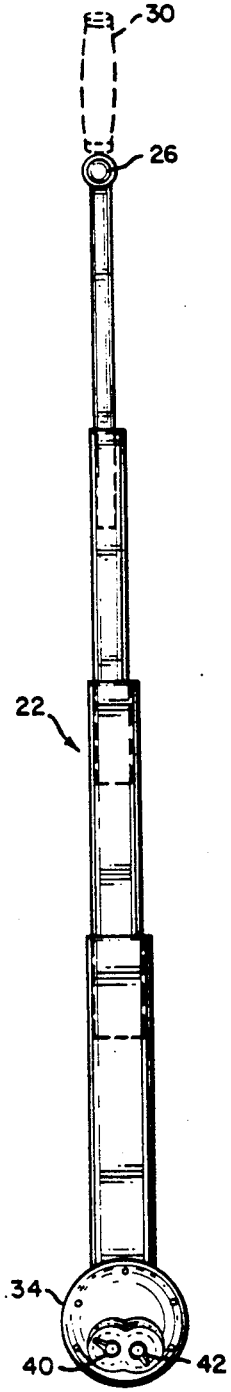
FIG. 2 is a side view of the exercise device of FIG. 1.

FIG. 2 is a side view of FIG. 1, and shows the arm 22, the handle 26 and an alternate position of the handle, designated by the reference numeral 30. Also shown in FIG. 2 are the force adjustment knobs and pointers 40 and 42 which permit varying of the level of the substantially constant force of the hydraulic resistance unit, as discussed in greater detail hereinbelow.

Figure 3:
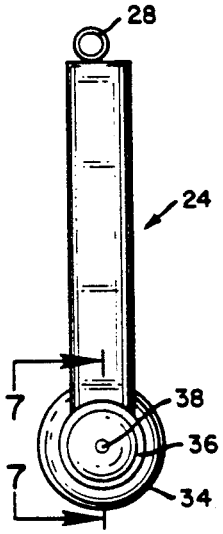
FIG. 3 is a side view of the exercise device of FIGS. 1 and 2, with the extendable arms in their fully telescoped or retracted position.

FIG. 3 is a view of the apparatus of FIGS. 1 and 2 taken from the opposite side of the showing of FIG. 2, and with the arm 24 being shown in its telescoped configuration.

Reference will now be made to FIGS. 4 through 7 of the drawings in which the hydraulic resistance element and its coupling to the two arms 22 and 24 will be considered. Initial attention will be directed to FIG. 7 in which the two arms 22 and 24, the hydraulic resistance unit 34, the housing 36 and the quick release actuator 38 may be noted. Now, referring to FIGS. 7 and 4, within the housing 34 is a rotatable vane 46 mounted on a rotatable shaft 48. The housing 34 is rigidly keyed to the inboard arm 22 by the reinforcing member 50. The inwardly extending keys are shown in dashed lines at 52, 54 in FIG. 7.

Figure 7:
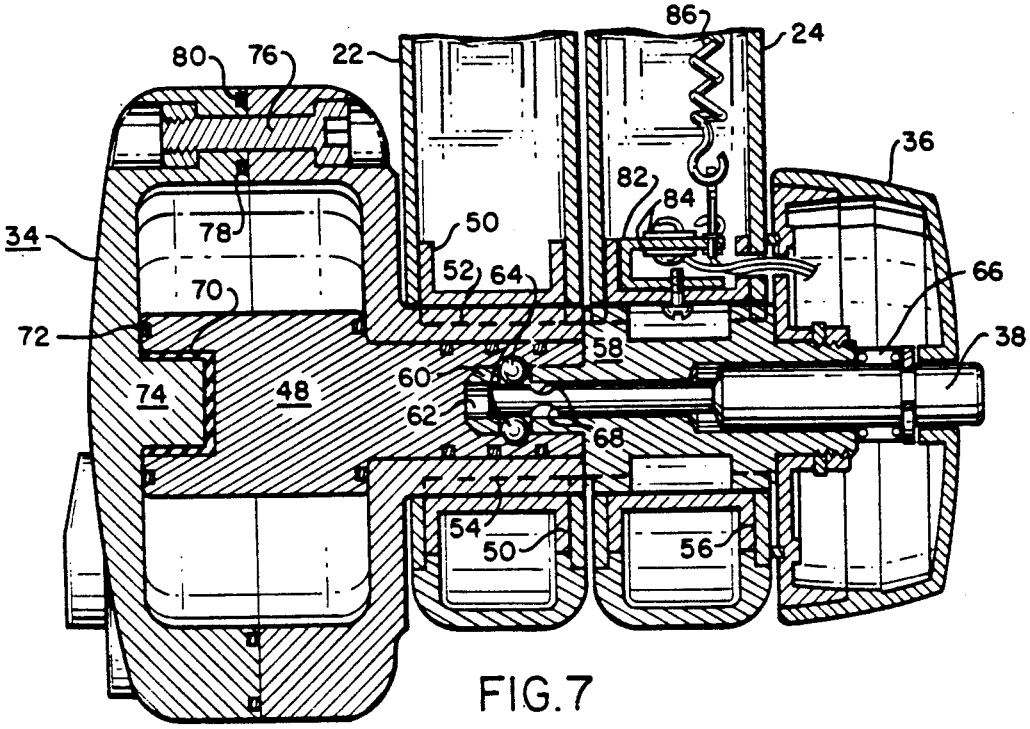
FIG. 7 is a cross-sectional view taken along Section 7—7 of FIG. 3, generally parallel to the pivot axis of the apparatus.

In a similar manner, the exercise arm 24 is reinforced by the member 56, which is in turn keyed to the rotating member 58 by inwardly directed portions of the arm 24 and the reinforcing member 56. The member 58 is keyed to the shaft 48 upon which the vane 46 is mounted by special configuration of the inwardly extending end 60 of the rotating shaft 58, such as a "D" or "double-D" cross-sectional configuration, and a correspondingly shaped recess 62 in the shaft 48. The quick release member 38 as shown in FIG. 7 includes the ball-bearings 64 which extend into an annular recess in the right-hand end of shaft 48. The spring 66 normally biases the quick release actuator 38 in the right-hand direction as shown in FIG. 7, so that the ball-bearings 64 hold the assembly in the indicated position. However, when the right-hand end of shaft 38 is depressed, with a person's thumb, for example, the ball-bearings 64 drop into the recesses 68, and release the member 58 from the shaft 48. Once this has been accomplished, the outboard exercise arm 24 may be removed from the assembly along with the shaft 58, and the inboard arm 22 may be slid off the outside of the housing 34.

Figure 4:
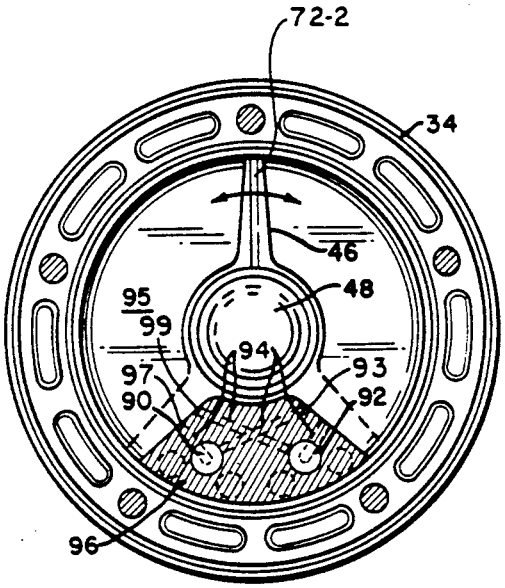
FIG. 4 is a cross-sectional view through the hydraulic resistance unit which is mounted along the pivot axis of the two arms of the exercise apparatus shown in FIGS. 1 through 3.

It may also be noted that the left-hand end of the shaft 48, as shown in FIG. 7, is provided with a bearing 70 and an O-ring seal 72 where it interfits with the inwardly directed protrusion 74 from the housing 34. The seal 72 may be made of 3 parts 72-1, 72-2, and 72-3, with 72-1 and 72-3 being in the nature of O-rings as shown in FIG. 7 and wiper seal portion 72-2 extending along the edge of the vane 46 as shown in FIG. 4. The housing 34 is made up of two parts, and they are held together by a series of threaded fasteners 76, with two peripheral O-rings 78 and 80 being provided to seal the housing and retain the hydraulic fluid within the housing 34.

Figure 8:
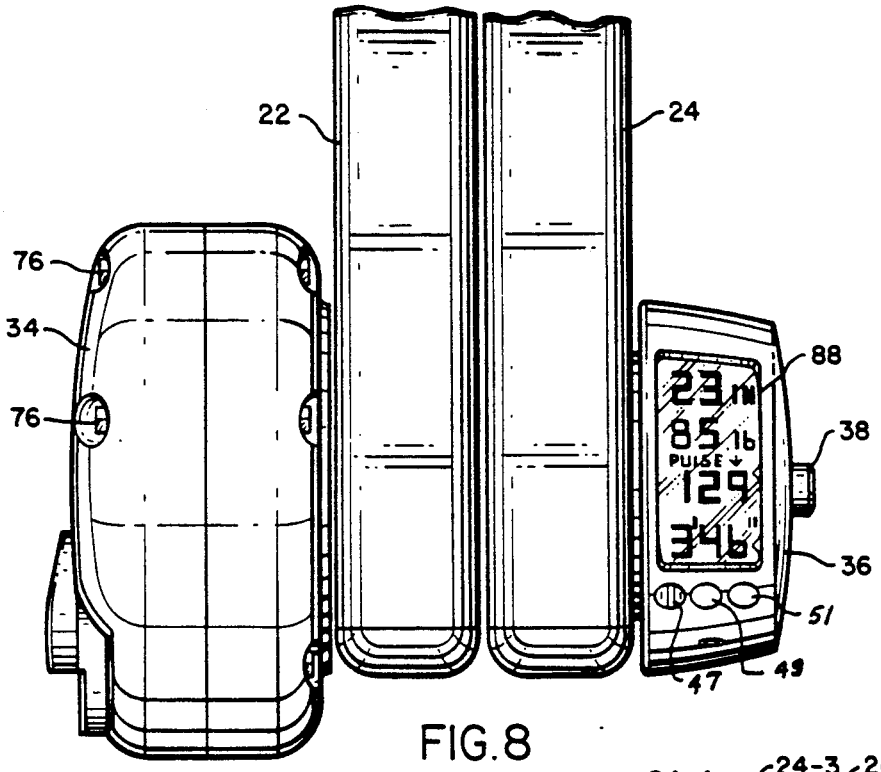
FIG. 8 is an external view similar in orientation to the cross-sectional view of FIG. 7.

Concerning another minor point, a resilient springy metal member 82 is provided with strain gauges 84 mounted on its upper and lower surfaces. The member 82 is deflected by a spring 86 coupled toward the outer end of the outermost telescoping section 24-4, so that, as the arm is extended, the member 82 is deflected and the reading from the strain gauges 84 will represent the length of the arms. This may be displayed on a display 88 as indicated in FIG. 1 and FIG. 8 of the drawings, for example. In order to attach the spring 86 toward the outer end of section 24-4, the section may be provided with a hole or groove.

Now, with reference to FIG. 4, as the two arms 22 and 24 are shifted in their angular orientation relative to one another, the vane 46 and the shaft 48 will rotate, forcing fluid to flow through one of the passageways 94, each of which are coupled to the hydraulic fluid reservoir 95 on both sides of the metal structure 96 which is fixed to and occupies about 90 degrees of the space within the housing 34.

When the vane 46 as shown in FIG. 4 is rotating clockwise, to the right as shown in FIG. 4, fluid is forced into inlet 93 at the right hand side of member 96, through chamber 90 and out the exit opening 97 on the left hand side of member 96. When the arms 22 and 24 are rotated relative to one-another in the opposite direction, the vane 46 is rotated in the opposite direction, counterclockwise as shown in FIG. 4, and forces the hydraulic fluid into inlet orifice 99, through the chamber 92, and out the exit opening 101 on the right hand side of member 96, as shown in FIG. 4.

One of the features of the present exercise apparatus is the arrangements whereby substantially constant resistance force is provided, notwithstanding varying the speed of actuation of the two arms relative to one another. This feature is accomplished by the use of a hydraulic bucket structure, which is shown in greater detail in FIGS. 5 and 6 of the drawings. As shown in FIG. 4, there are two hydraulic bucket arrangements 90 and 92, and each of them is connected to both sides of the chamber divider 96 by the passageways 94. When the vane or "wiper" 46 is operative in one direction, one of the hydraulic bucket devices is operative; and when the direction of movement of the wiper 46 is reversed by movement of the arms in the opposite direction, then the other of the two hydraulic bucket assemblies becomes active.

Figure 6:
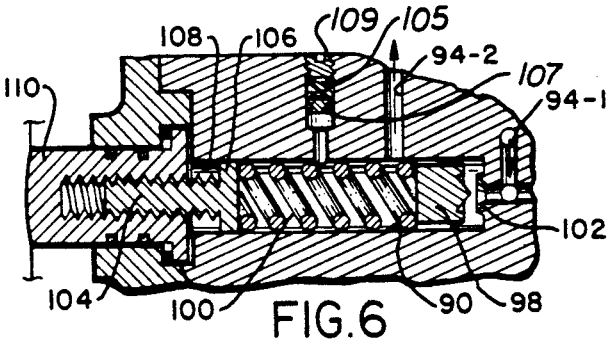
FIG. 6 is an enlarged view of the reverse Pelton bucket arrangement whereby substantially constant resistance force is provided despite variations in the speed of actuation of the arms of the exercise device.

With reference to FIG. 6 of the drawings, fluid is applied to the chamber 90 through channel 94-1, and is discharged to the other side of the member 96 through the other channel 94-2. As the fluid is driven by the wiper or vane 46, it enters the channel 94-1 at very high velocities and impinges on the hydraulic bucket element 98, pushing it in the left-hand direction as shown in FIG. 6, against the force of the spring 100. When the hydraulic fluid hits the element 98, the hydraulic bucket deflects the fluid, creating a reaction force proportional to the velocity. Accordingly, with relatively low velocity, the hydraulic bucket element 98 remains relatively close to the seat 102, and a relatively high resistance is encountered for the hydraulic fluid flow from channel 94-1 around element 98 to channel 94-2. However, at significantly higher velocities, spring 100 will be compressed, the element 98 will move back to the left, as shown in FIG. 6, and a significantly lower resistance path will be available between the input and output channels. This will counteract the normal significantly increased resistance encountered when an effort is made to force fluids through small passageways at high velocities. The result is that a relatively constant resistance force is encountered when the two arms of the exercise apparatus are moved relative to one another, either at high velocities or at relatively slow velocities.

The level of force provided by the hydraulic bucket 98 is controlled by adjusting the tension of the spring 100 by shifting the position of the spring support member 104. The enlarged end 106 of the threaded support member 104 is keyed to a pair of slots 108 in the opening 90 containing the hydraulic bucket assembly. By rotation of the control element 110, the position of the spring 100 may be adjusted to vary the force applied to the hydraulic bucket element 98, thus controlling the level of force required to move the arms 22 and 24 relative to one another.

Incidentally, the hydraulic bucket members may be individually adjusted so that a different force is encountered in moving the arms in one direction as compared with the opposite direction. In addition, it may be noted that, when the vane is moving in the opposite direction, so that higher pressure is present at channel 94-2, then at 94-1, with reference to FIG. 6, then the hydraulic bucket element is forced up against its seat 102, effectively acting as a one-way valve and forcing the flow of fluid to the adjacent hydraulic bucket channel 92 as shown in FIG. 4. If desired, of course, automatic valving arrangements may be provided to direct fluid through a single hydraulic bucket assembly for both directions of movement of the vane 46, thereby slightly reducing costs.

Figure 5:
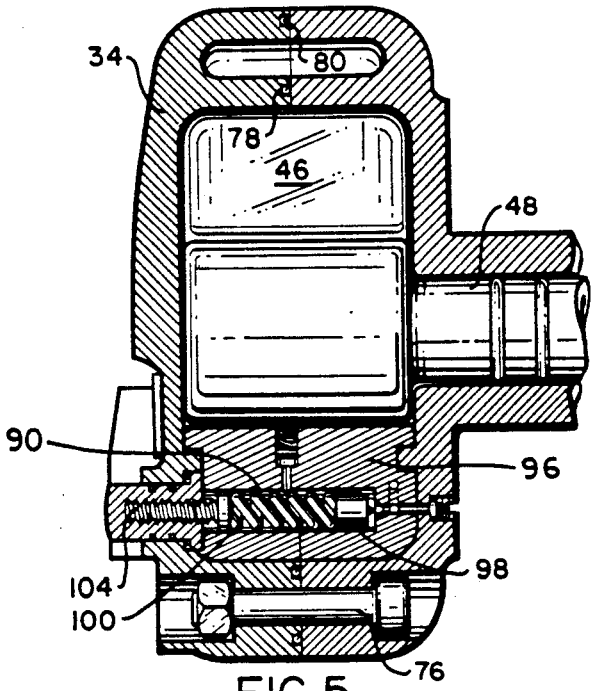
FIG. 5 is another cross-sectional view of the hydraulic resistance element, with the view of FIG. 5 being taken parallel to the pivot axis of the apparatus.

With reference to FIGS. 5 and 6, an assembly, including spring 105, piston 107, and threaded closure 109, is shown in these figures just above chamber 90. This assembly permits the support members 104 to be advanced into and retracted from the total system liquid-filled volume, of the exercise device after it has been completely filled with a virtually non-compressible fluid.

The piston 107 closely fits into the enclosing chamber with an appropriate peripheral O-ring or rings and is engaged by the spring 105, which in turn is supported by a threaded closure 109. As support member 104 advances into chamber 90, as discussed above, its newly inserted volume moves the piston 107 upwardly (on these figures) to allow an increase in total system volume equal to the portion of part 104, 106 inserted into the total system volume.

The spring constant of the spring 105 is stiff enough to allow this displacement without creating an otherwise "soft" or "spongy" action into the system, the result of which would be a loss of the predictably constant resistance at the arms 22 and 24 and the actuators 30.

Similarly, when the support member 104 is withdrawn from the chamber 90 to the left in FIGS. 5 and 6, the piston 107 accordingly drops by the force of the spring 105 to prevent cavitation in the hydraulic fluid. Cavitation, or air bubbles in the fluid are most undesirtable as they defeat predictable linear resistance.

Another embodiment of the assembly could be a simple volume of an appropriately compressible, semirigid elastomer inserted into the chamber in place of the piston 107 and spring 105, thus reducing costs with no loss of benefit to the device.

FIG. 8 is an alternative showing indicating the display which is provided on housing 36 in greater detail. More specifically, a liquid crystal or LED display 88 may be provided. The information shown on the LED display may include the following: At the top, an indication of the number of inches which is the adjusted extent of arm 24, with the other arm normally being extended to the same distance. The second indication is that of the amount of force required to move the arms relative to one another. The pulse rate is indicated in the next reading and this may be implemented by a separate pulse measuring attachment which may be clipped onto the ear lobe or to a finger, for example, of the person who is exercising. This attachment is, of course, optional. The lowermost indication on the display is the number of minutes during which the exercising has been continuing.

Incidentally, in FIG. 8 at the bottom of the display are calibration screw 47 and electronic display control buttons 49 and 51.

Figure 9:
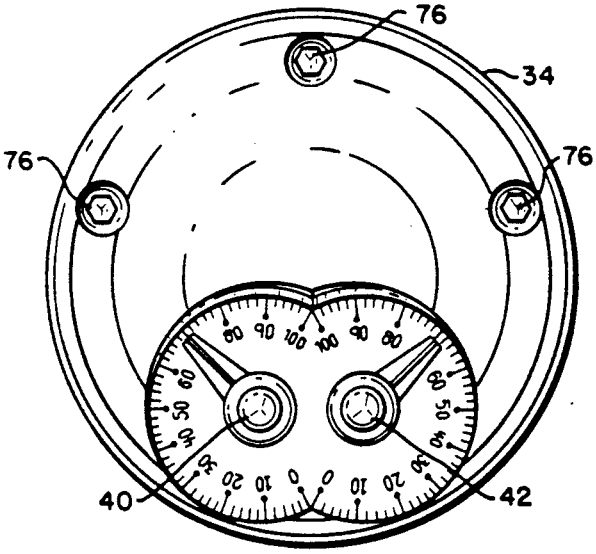
FIG. 9 is an external view taken from the left of FIG. 8, and showing the force-adjusting mechanism to control the resistance encountered as the arms are being moved.

FIG. 9 shows an enlarged view of the housing 34 together with the adjusting knobs and pointers 40 and 42. As mentioned above, these control the tension applied to the spring 100 within the Pelton bucket assembly. The scales on the two pointers indicate the relative resistance required for operating the arms in one direction and in the other direction, respectively.

Figure 10:
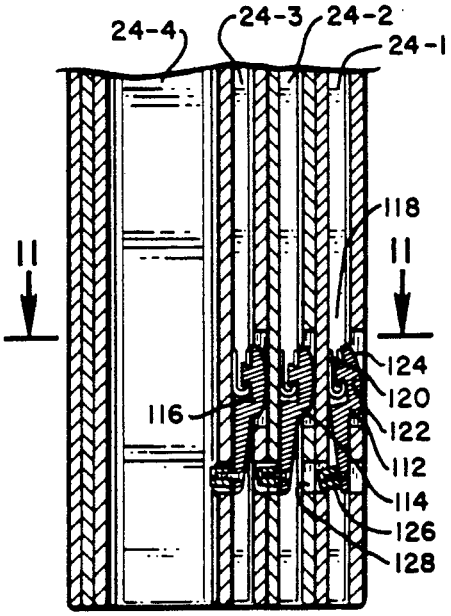
FIG. 10 is a view through one of the arms of the exercise device of FIGS. 1 through 3, showing the detents which hold the telescoping sections of the arms in fixed positions relative to one another.
Figure 11:
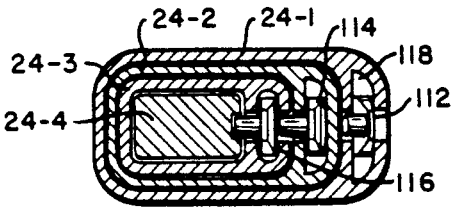
FIG. 11 is a cross-sectional view of the detents, taken along lines 11—11 of FIG. 10.
Figure 12:
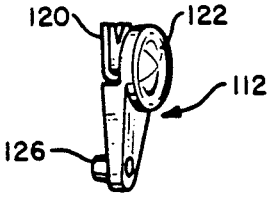
FIG. 12 is a detail showing of one of the detents separate from the remainder of the exercise apparatus assembly.

FIGS. 10, 11 and 12 show in some detail the detent arrangements for holding the telescoping sections of the arms in the desired fixed positions relative to one another. More specifically, as shown in FIGS. 10 and 11, the three larger sections of the arm, 24-1, 24-2, and 24-3, are provided with thumb-actuated detents 112, 114, and 116, respectively.

In reviewing the mounting arrangements for the thumb detents, it may be noted that the detent 112 is mounted in an open channel 118 on one side of the arm 24-1, and is mounted on a spring 120 with the head 122 of the detent 112 being accessible through an opening 124 through the outer wall of the arm section 24-1. Note that, with pressure applied to the head 22 of the detent 112, its end 126 is released from the detent opening 128 in the next inner telescoping section 24-2 of the arm 24, so that the inner sections of the telescoping arm may be shifted outwardly toward the position indicated in FIG. 1 of the drawings. After the detent 114 becomes exposed, it may also be depressed to release the next inner telescoping section of the arm, etc. It may also be noted that the inner detents such as detent 114 and 116, are normally located so that telescoping movement of the sections of the arm is not hindered.

Incidentally, FIG. 12 is a showing of one of the detents 112 separate from the remainder of the assembly.

Figure 13:
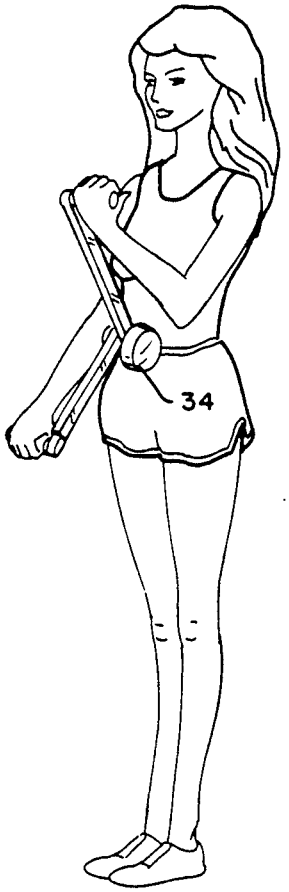
FIG. 13 shows a typical exercise using the exercise apparatus with the arms substantially fully telescoped or collapsed, and the handles oriented perpendicular to the two arms.

FIGS. 13 through 17, are substantially self-explanatory, and show the versatility of the exercising device of the present invention. In FIG. 13, it may be noted that the arms 22 and 24 are adjusted to a length substantially equal to that of the forearms of the person using the exercise device, with the pivot point of the arms and the housing 34 being located at a position near the elbow which constitutes the pivot point between the forearm and the upper arm, thus facilitating normal exercise of the body. Similarly, in FIG. 15, an arrangement is shown in which the length of the arms is comparable to the distance between the knees and the ankle of the user. By using a constant resistance actuator, and arms adjustable to facilitate coincidence of the pivot points of the appartus and the body, linear resistance to muscle actuation is achieved, with resultant optimal muscle development without irregularly bulging muscles.

Figure 15:
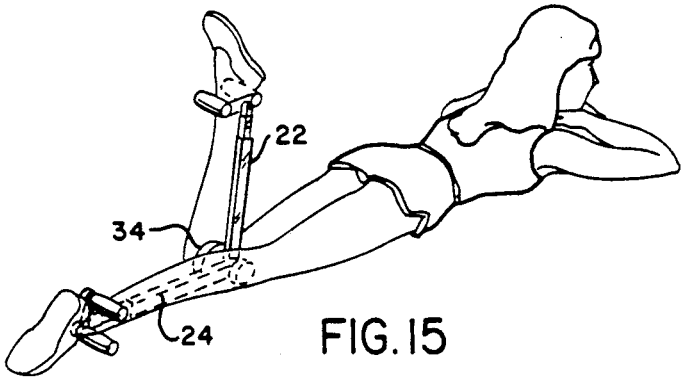
FIG. 15 shows an arrangement using two handles on each of the two arms with the handles being cushioned for easy operation by the ankles of the user, and with the arms of the exercise apparatus in their partially extended position.

In addition, in connection with FIG. 15, it may be noted that dual handles are employed on each arm, with each of the handles being padded, to facilitate comfortable use of the device with pressure between the ankles and the handles.

Figure 16:
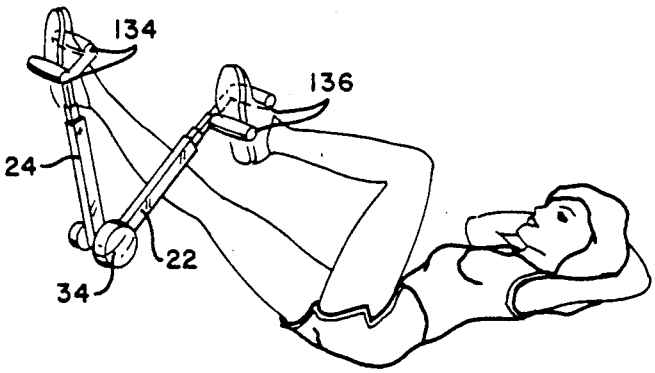
FIG. 16 shows the exercise apparatus being employed with two handles on each of the two arms of the exercise device, and with the exercise arms in their partially extended position to facilitate a bicycle-type exercise, as illustrated.
Figure 14:
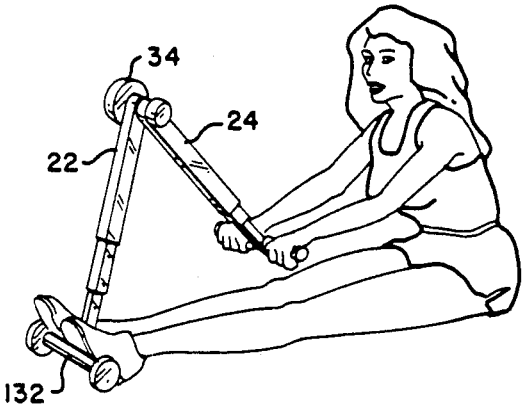
FIG. 14 shows a rowing exercise in which the arms of the exercise apparatus are partially extended, and in which one arm is provided with two handles, and the other arm is provided with rollers, to facilitate the rowing-type exercise.
Figure 17:
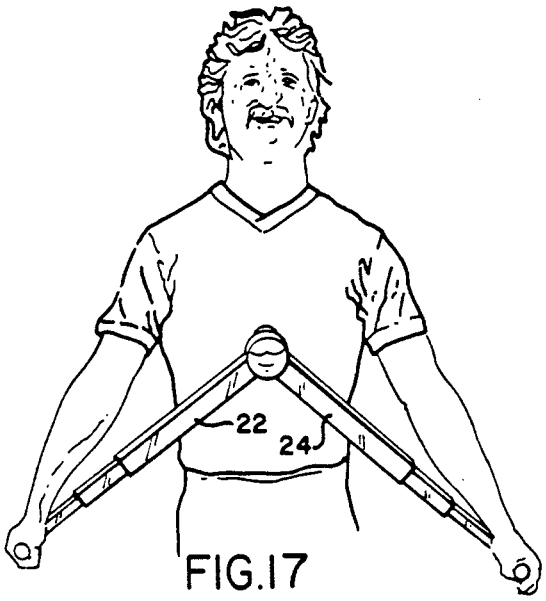
FIG. 17 shows a man using the exercise device in an intermediate extension range, and with the handles mounted perpendicular to the ends of the respective arms.
Figure 20:
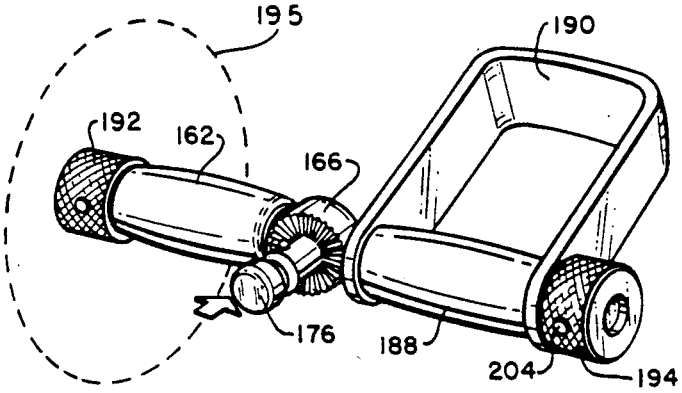
FIG. 20 is a diagrammatic showing of a double handle arrangement.

FIG. 14 shows the exercise device set up using rollers 132 secured to the outer ends of the handles of the arm 22, while double handles are provided at the end of the arm 24. FIG. 16 shows the use of the exercise device with double handles 134 and 136 secured to the ends of the arms 22 and 24 in a manner similar to the arrangement of FIG. 15. Stirrups as shown in FIG. 20 could also be used. FIG. 17 shows the exercise device being used by a man with relatively high power settings, to satisfy the need for a heavy exercising force. In addition, the extension of the arms 22 and 24 is somewhat greater than in the case of a number of the exercises being performed by the woman user.

Figure 18:
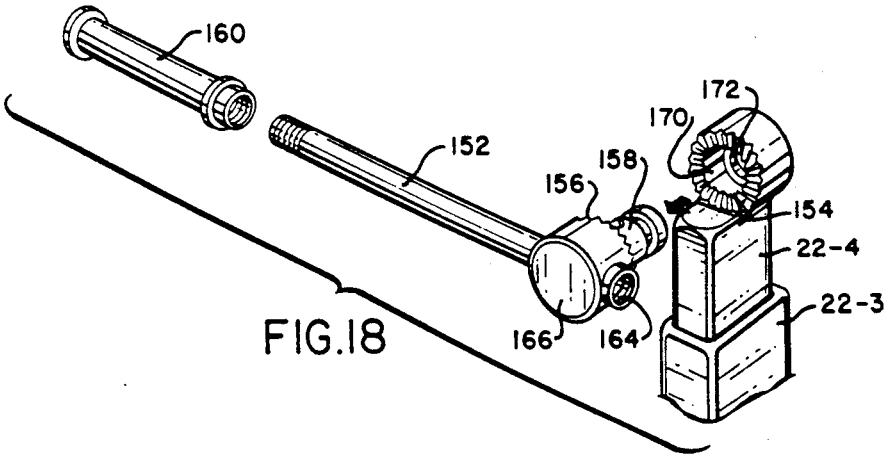
FIG. 18 is a diagrammatic showing of the coupling of one of the handles to one of the arms of the exercise apparatus.

FIG. 18 is a diagrammatic showing of one arrangement for mounting the handle support member 152 at any desired angle on the outer end of the outermost telescoping section 22-4 of the arm 22. As shown in FIG. 18, the ratchet-type surfaces 154 and 156 mate, and are held together by the quick release mechanism 158. The quick release mechanism 158 may be released, and the angle of orientation of the handle support 152 may be shifted to any desired angle, and then fixed back into position. The sleeve 160 is rotatably mounted on the shaft 152, so that, after the grip 162 is assembled on the sleeve 160 the grip may be rotated as the exercise apparatus is in use and tensioners by the knob 192, to control the twist resistance of the handles which shows a more controlled swing of the arms.

Figure 21:
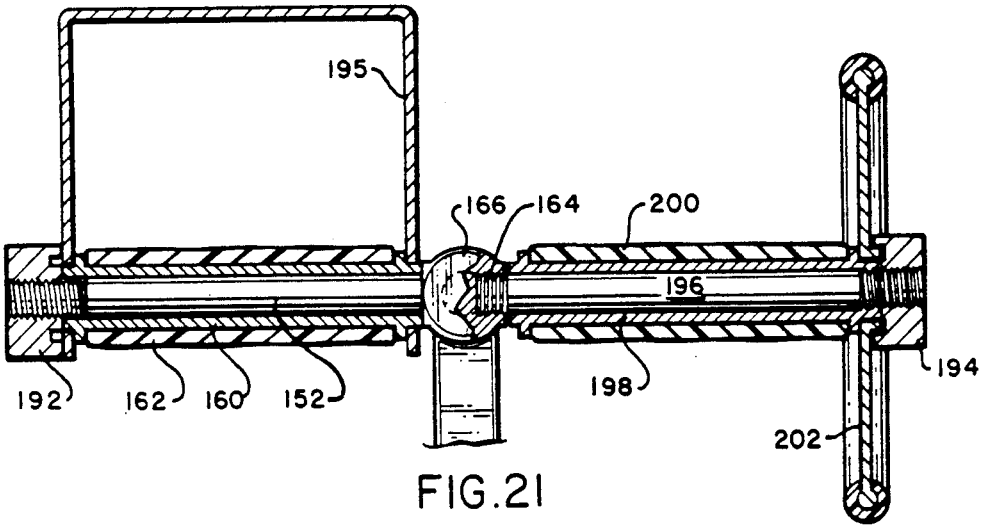
FIG. 21 is a cross-sectional view showing how stirrups and wheels are to be attached to the exercise apparatus.

Incidentally, referring back to FIG. 18, the threaded opening 164 is provided to accept a second handle, as shown in FIGS. 20 and 21.

Figure 19:
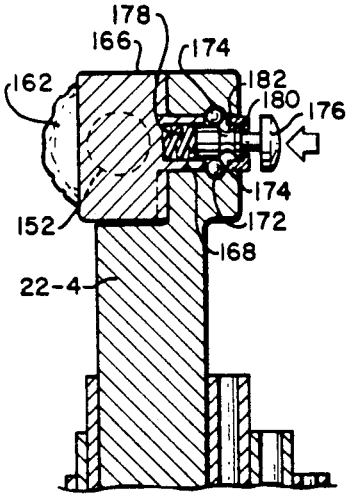
FIG. 19 is a cross-sectional view of the quick release mechanism for the handles.

The details of the quick release mechanism are shown in FIG. 19. In FIG. 19, the hub 166, which is integral with the shaft 152, has an inwardly extending tubular member 168 which makes a close fit with the mating opening 170 at the end of the telescoping arm section 22-4, as shown in FIG. 18. A recess 172 extends outwardly from the opening 170, and two metal balls 174 which are mounted and retained in holes in the sleeve 168, are forced out into the recess 172 when the release member 176 is forced to the right by the biasing pressure from the spring 178. A flange 180 retains the member 176 as part of the handle assembly. When the member 176 is pushed inwardly, the balls 174 may move inwardly into the recesses or peripheral groove 182 in member 176, releasing the hub 166 from the telescoping arm member 22-4, and permitting adjustment of the angle of the handle, or the substitution of a different handle member.

FIG. 20 is a showing of the handle assembly, with the hub 166 separate from the telescoping arm section 22-4. In addition, a second handle member 188, provided with a stirrup 190, formed of flexible plastic cloth, leather, or other material, and with both of the two handles 162 and 188 being held in place by the threaded members 192 and 194 which may be knurled on their outer surface for ease in screwing them into place on the outer ends of the handle rods, such as that shown at 152 in FIG. 18. The circle 195 represents the location of a wheel such as that shown in FIG. 21, when a wheel is employed in the embodiment of FIG. 20.

FIG. 21 is a cross-sectional view showing the hub 166 having the handle support shaft 152 extending in one direction, with the sleeve 160 and the grip 162 concentrically mounted on shaft 152. The cap member 192 holds the assembly together, with the stirrup 195 mounted as indicated in FIG. 21. A second handle shaft 196 is threaded into the internal threads 164 in hub 166, and is similarly provided with a sleeve 198 which may rotate on the shaft 196, and an outer grip or handle 200 mounted on the sleeve 198. A wheel 202 is mounted at the right-hand end of shaft 196, as shown in FIG. 21, and is held in place by the cap, or tensioning knob 194. If desired, a set screw 204 may be provided to secure the tensioning knob 194 securely onto the shaft 196. It is to be understood, of course, that two wheels, or two stirrups may be employed, instead of the composite showing of FIG. 21. In addition, two handles may be secured to the end of the members 22, as shown in FIGS. 15 and 16 of the drawings, in place of a single handle and a stirrup.

Figure 22:
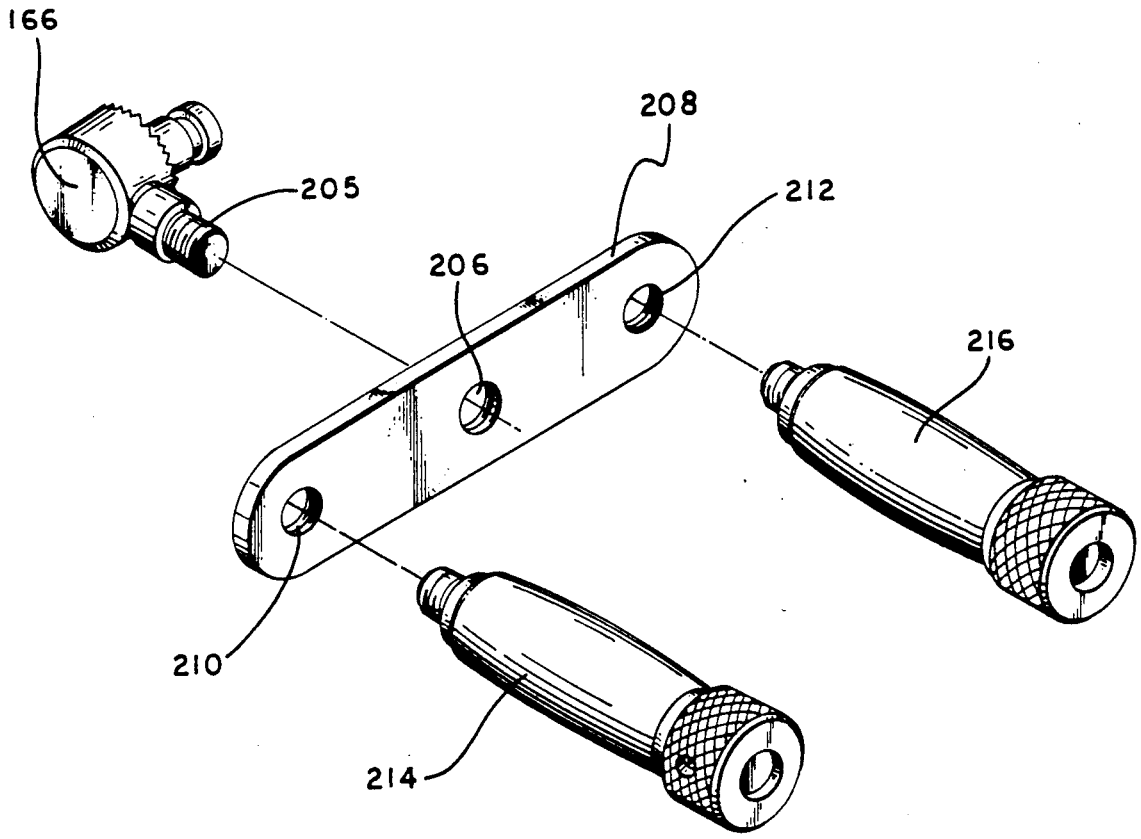
FIG. 22 is an exploded view of a construction configuration to implement the exercises shown in FIGS. 15 and 16.

FIG. 22 shows the preferred mechanical construction for the exercises indicated in FIGS. 15 and 16 wherein two handles are employed on each arm. More specifically, a part 166 as described above in connection with FIG. 18 has a threaded and shouldered part 205 secured thereto, and the central threaded hole 206 in plate 208 mates with part 205 and holds the plate 208 to member 166. Additional threaded holes 210 and 212 serve to secure the handles 214 and 216, respectively, to the plate 208.

In conclusion, it is to be understood that the exercise apparatus embodiment as described hereinabove and disclosed in the accompanying drawings is illustrative of the principles of the invention. However, changes may be made without departing from the spirit and scope thereof. Thus, by way of example and not of limitation, the telescoping tubes forming the arms of the apparatus may be circular rather than rectangular; and alternative detent mechanisms and resistance units may be employed. Also, instead of a spring and strain gauges for sensing the extension of the arms, this may be accomplished by a digital optical encoder or a spool with a wire attached to the outer arm, for example. Also, the hydraulic bucket principle may be employed in other types of exercise apparatus to provide substantially constant resistance. Accordingly, the present invention is not limited to the preferred embodiment as shown in the drawings and described in detail hereinabove.

What is claimed is:

1. A compact portable multi-purpose exercise apparatus having substantially constant resistance with variable speed of actuation, comprising:

first and second intercoupled arms, pivotally interconnected relative to one-another at one end of each of said arms, said arms having adjustable orientation actuators mounted at the other ends of each of said arms;

means for adjusting the length of each of said arms from about one foot to about three feet;

hydraulic resistance means mechanically coupled to said two arms at their ends which are pivotally interconnected to provide substantially constant resistance to relative pivotal movement of said arms with respect to one-another despite variations in the speed of actuation of said arms;

said hydraulic means for providing constant resistance including a spring biased flow controlling means movable to progressively reduce hydraulic fluid flow resistance with higher velocities of fluid flow when said arms are operated at higher speed, said progressive reduction in resistance taking place throughout the normal range of speed of operation of the exercise devices;

said hydraulic resistance means including an elongated chamber having longitudinally spaced ports, and means for mounting said flow controlling means within said chamber for movement between said ports, said flow controlling means having substantial space between the side thereof and the walls of said chamber to permit limited flow of fluid past said controlling means; and means for adjusting the resistance of said hydraulic resistance means.

2. A compact multi-purpose exercise apparatus as defined in claim 1 wherein each of said arms includes a plurality of telescoping intercoupled sections for implementing said length adjustment means.

3. A compact multi-purpose exercise apparatus as defined in claim 2 further comprising substantially flat thumb actuated locking detent means for holding said telescoping sections of said arms in fixed relative positions relative to one another.

4. A compact multi-purpose exercise apparatus as defined in claim 3 wherein at least one of said telescoping sections is provided with a plurality of closely spaced openings for receiving a locking detent means secured to an adjacent telescoping section.

5. A compact multi-purpose exercise apparatus as defined in claim 3 wherein said locking means includes thumb actuated spring mounted detents mounted on outer sections of said arms and extending into openings or recesses in the underlying or inner telescoping sections of said arms.

6. A compact multi-purpose exercise apparatus as defined in claim 1 wherein said hydraulic constant resistance means is in the form of a hydraulic bucket member having a concave region and means for directing hydraulic fluid onto said member.

7. A compact multi-purpose exercise apparatus as defined in claim 1 wherein said actuators are handles, and further including means for mounting said handles at different angles relative to said arms.

8. A compact multi-purpose exercise apparatus as defined in claim 1 wherein said actuators are pairs of handles mounted at the ends of each of said arms for actuation by the feet or ankles.

9. A compact, multi-purpose exercise apparatus having substantially constant resistance with variable speed of actuation, comprising:

first and second intercoupled arms, pivotally interconnected at one end of each of said arms, said arms having adjustable orientation actuators mounted at the other ends of each of said arms;

means for adjusting the length of each of said arms from about one foot to about three feet;

hydraulic resistance means mechanically coupled to said two arms at their ends which are pivotally interconnected to provide substantially constant resistance to relative pivotal movement of said arms with respect to one-another despite variations in the speed of actuation of said arms;

said hydraulic means for providing constant resistance including a spring biased flow blocking means movable to reduce hydraulic fluid flow resistance with higher velocities of fluid flow when said arms are operated at high speed;

means for adjusting the resistance of said hydraulic resistance means; and one of said actuators on one arm including a pair of rollers, and the other of said actuators on the other arm being a double handle extending substantially perpendicular to said other arm on each side thereof, to facilitate the execution of rowing type exercises.

10. A compact, multi-purpose exercise apparatus having substantially constant resistance with variable speed of actuation, comprising:

first and second exercise members movable relative to one another; actuator means for moving said exercise members by the person performing the exercise;

hydraulic resistance means mechanically coupled to said two exercise members to provide substantially constant resistance to relative movement of said members with respect to one another despite variations in the speed of actuation of said members; said hydraulic means for providing substantially constant resistance including a spring-biased flow controlling means movable to progressively reduce hydraulic fluid flow resistance with higher velocities of fluid flow when said members are operated at higher speed, said progressive reduction in resistance taking place throughout the normal range of speed of operation of the exercise device;

said hydraulic resistance means including an elongated chamber having longitudinally spaced ports, and means for mounting said flow controlling means within said chamber for movement between said ports, said flow controlling means having substantial space between a side thereof and the walls of said chamber to permit limited flow of fluid past said controlling means; and means for adjusting the resistance of said hydraulic resistance means.

11. A compact multi-purpose exercise apparatus as defined in claim 10 wherein said hydraulic resistance means is in the form of at least one hydraulic bucket member having a concave region and means for directing hydraulic fluid onto said member.

12. A compact, multi-purpose exercise apparatus comprising:

first and second intercoupled arms, pivotally interconnected at one end of each of said arms, to rotate about an axis of rotation, said arms having adjustable orientation actuators mounted at the other ends of each of said arms, said actuators being adjustable to orientations substantially perpendicular to said arms and substantially parallel to said axis of rotation;

means for adjusting the length of each of said arms from a first predetermined overall length to a second overall length at least twice as great as said first predetermined length;

resistance means mechanically coupled to said two arms at their ends which are pivotally interconnected, to provide substantially constant resistance to relative pivotal movement of said arms;

means for adjusting the resistance of said reistance means; and said apparatus being self-contained and free of any connection to additional frame or support members;

whereby the overall two-to-one reduction in length of the arms permits portability and convenient storage of the exercise apparatus.

13. A compact multi-purpose exercise apparatus as defined in claim 12 wherein each of said arms includes at least three telescoping intercoupled sections for implementing said length adjustment means 14. A compact multi-purpose exercise apparatus as defined in claim 12 further comprising substantially flat thumb actuated locking detent means for holding said telescoping sections of said arms in fixed relative positions relative to one another.

15. A compact multi-purpose exercise apparatus as defined in claim 14 wherein at least one of said telescoping sections is provided with a plurality of closely spaced openings for receiving a locking detent means secured to an adjacent telescoping section.

16. A compact multi-purpose exercise apparatus as defined in claim 14 wherein said locking means includes thumb actuated spring mounted detents mounted on outer sections of said arms and extending into openings or recesses in the underlying or inner telescoping sections of said arms.

17. A compact multi-purpose exercise apparatus as defined in claim 12 wherein said actuators are handles, and further including means for mounting said handles at different angles relative to said arms.

18. A compact multi-purpose exercise apparatus as defined in claim 12 wherein said actuators are stirrups mounted at the ends of each of said arms for actuation by the feet or ankles.

19. An apparatus as defined in claim 12 wherein each of said arms includes at least three sections which telescope within one-another.

20. An exercise apparatus as defined in claim 19 further comprising spring biased piston means exposed to the hydraulic fluid in said apparatus, whereby changes in the volume of the hydraulic fluid may be accommodated.

21. A compact, multi-purpose exercise apparatus having substantially constant resistance with variable speed of actuation, comprising:

first and second intercoupled arms, pivotally interconnected at one end of each of said arms, said arms having actuators mounted at the other ends of each of said arms;

hydraulic resistance means mechanically coupled to said two arms at their ends which are pivotally interconnected to provide substantially constant resistance to relative pivotal movement of said arms with respect to one-another despite variations in the speed of actuation of said arms; and said hydraulic resistance means including at least one elongated hydraulic chamber having longitudinally spaced inlet and outlet ports, a flow control member mounted in said chamber and capable of being located in said chamber between said ports, said control member having substantial space around the sides thereof between the flow control member and the walls of said hydraulic chamber, spring biasing means for controlling the position of said control member between said two ports for movement from a position at or adjacent said inlet port when fluid pressure is low when said exercise system is being operated slowly, progressively to a position near said outlet port but with said control member still partially blocking said outlet port when said pressure is increased by significantly increasing the speed at which said exercise system is operated; and a housing adjacent the connection point of the arms and rigidly attached to one of said arms containing a fluid compartment, a paddle means within said fluid compartment connected to the other of said arms, and the hydraulic resistance means.

22. A compact portable multi-purpose exercise apparatus having substantially constant resistance with variable speed of actuation, comprising:

first and second intercoupled arms, pivotally interconnected at one end of each of said arms, to rotate about an axis of rotation, said arms having adjustable orientation actuators mounted at the other ends of each of said arms, said actuators being adjustable to orientations substantially perpendicular to said arms and substantially parallel to said axis of rotation means for adjusting the overall length of each of said arms from about one foot to about three feet;

hydraulic resistance means mechanically coupled to said two arms at their ends which are pivotally interconnected to provide substantially constant resistance to relative pivotal movement of said arms with respect to one-another despite variations in the speed of actuation of said arms;

said hydraulic means for providing constant resistance including a spring biased flow controlling means movable to progressively reduce hydraulic fluid flow resistance with higher velocities of fluid flow when said arms are operated at higher speed, said progressive reduction in resistance taking place throughout the normal range of speed of operation of exercise devices;

means for adjusting the resistance of said hydraulic resistance means; and said exercise apparatus being portable, self-contained and independent of coupling to any additional frame or support members.

23. A compact, multi-purpose exercise apparatus comprising:

first and second intercoupled arms, pivotally interconnected at one end of each of said arms, said arms having adjustable orientation actuators mounted at the other ends of each of said arms;

means for adjusting the overall length of each of said arms from a first predetermined length to a second length at least twice as great as said first predetermined length;

resistance means mechanically coupled to said two arms at their ends which are pivotally interconnected, to provide substantially constant resistance to relative pivotal movement of said arms;

means for adjusting the resistance of said resistance means;

means coupled to said arms for sensing the length of said arms, and electronic display means mounted on said apparatus for visually displaying an indication of the length of said arms; and said apparatus being self-contained and free of any connection to additional frame or support members.

24. A compact portable multi-purpose exercise apparatus having substantially constant resistance with variable speed of actuation, comprising:

first and second intercoupled arms, pivotally interconnected relative to one-another at one end of each of said arms, said arms having adjustable orientation actuators mounted at the other ends of each of said arms;

means for adjusting the length of each of said arms by a factor of at least two;

hydraulic resistance means mechanically coupled to said two arms at their ends which are pivotally interconnected to provide substantially constant resistance to relative pivotal movement of said arms with respect to one-another despite variations in the speed of actuation of said arms;

said hydraulic resistance means for providing constant resistance including a spring biased flow controlling means movable in a restricted channel to progressively reduce hydraulic fluid flow resistance with higher velocities of fluid flow when said arms are operated at higher speed, said progressive reduction in resistance taking place throughout the normal range of speed of operation of the exercise devices;

means for adjusting the resistance of said hydraulic resistance means, including arrangements which change the volume of the hydraulic fluid within said restricted channel included in the hydraulic resistance means portion of the exercise apparatus; and means coupled to said hydraulic resistance means and exposed to the hydraulic fluid within said exercise apparatus for accommodating said change in volume of the hydraulic fluid in said restricted channel.

25. An exercise device as defined in claim 24 wherein said means for accommodating said change in volume, includes a spring biased piston.

26. A compact, multipurpose exercise apparatus comprising:

first and second intercoupled arms, pivotally interconnected at one end of each of said arms, said arms having adjustable orientation actuators mounted at the other ends of each of said arms;

means for adjusting the length of each of said arms from a first predetermined length to a second length at least twice as great as said first predetermined length;

resistance means mechanically coupled to said two arms at their ends which are pivotally interconnected, to provide substantially constant resistance to relative pivotal movement of said arms;

said resistance means is a hydraulic resistance unit and includes a hydraulic bucket member having a concave region and means for directing hydraulic fluid onto said member;

means for adjusting the resistance of said resistance means; and said apparatus being self-contained and free of any connection to additional frame or support members.

27. A compact, multipurpose exercise apparatus comprising:

first and second intercoupled arms, pivotally interconnected at one end of each of said arms, said arms having adjustable orientation actuators mounted at the other ends of each of said arms;

means for adjusting the length of each of said arms from a first predetermined length to a second length at least twice as great as said first predetermined length;

resistance means mechanically coupled to said two arms at their ends which are pivotally interconnected, to provide substantially constant resistance to relative pivotal movement of said arms;

means for adjusting the resistance of said resistance means;

quick release means for separating said arms to permit compact storage of said apparatus, said quick release means including means for releasing by a single unidirectional actuation by a single finger; and said apparatus being self-contained and free of any connection to additional frame or support members.

28. A compact, multipurpose exercise apparatus comprising:

first and second intercoupled arms, pivotally interconnected at one end of each of said arms, said arms having adjustable orientation actuators mounted at the other ends of each of said arms;

means for adjusting the length of each of said arms from a first predetermined length to a second length at lease twice as great as said first predetermined length;

resistance means mechanically coupled to said two arms at their ends which are pivotally interconnected, to provide substantially constant resistance to relative pivotal movement of said arms;

means for adjusting the resistance of said resistance means;

quick release means for securing said actuators to the ends of said arms, said quick release means including means for releasing by a single unidirectional actuation by a single finger; and said apparatus being self-contained and free of any connection to additional frame or support members.

29. A compact, multipurpose exercise apparatus comprising:

first and second intercoupled arms, pivotally interconnected at one end of each of said arms, said arms having adjustable orientation actuators mounted at the other ends of each of said arms;

means for adjusting the length of each of said arms from a first predetermined length to a second length at least twice as great as said first predetermined length;

resistance means mechanically coupled to said two arms at their ends which are pivotally interconnected, to provide substantially constant resistance to relative pivotal movement of said arms;

means for adjusting the resistance of said resistance means;

electronic display means mounted on said exercise apparatus for displaying exercise parameters involving the use of said apparatus and coupled to receive input signals from said apparatus for displaying exercise parameters involving the use of said apparatus; and said apparatus being self-contained and free of any connection to additional frame or support members.

* * * * *